United States Patent [19]

Chasin et al.

[11] 4,038,767

[45] Aug. 2, 1977

[54] FLEXIBLE FLAG ADVERTISING SIGN

[76] Inventors: David Chasin, 1953 Edward Lane, Merrick, N.Y. 11566; Vincent Russo, Jr., 1152 85th St., Brooklyn, N.Y. 11228; Sam Foglio, 59 Paper Mill Road, Plandom Manor, N.Y. 11030, 4

[21] Appl. No.: 638,987

[22] Filed: Dec. 9, 1975

[51] Int. Cl.[2] ..... G09F 7/22

[52] U.S. Cl. ..... 40/125 H; 35/55; 211/45

[58] Field of Search ..... 40/125 H, 10 R, 145 A, 40/104.03, 102, 306, 312, 307, 125 R, 16.6, 13, 320, 322, 26; 35/55; 248/479, 475 B, 293; 211/45; 312/234.3, 234.5

[56] References Cited

U.S. PATENT DOCUMENTS

| | | | |
|---|---|---|---|
| 534,799 | 2/1895 | Koehler | 40/312 X |
| 1,572,994 | 2/1926 | Garfinkle | 40/16.6 |
| 1,600,887 | 9/1926 | Kimbrough | 248/479 |
| 2,879,898 | 3/1959 | Best | 211/45 |
| 2,946,454 | 7/1960 | Asher | 211/45 |
| 2,949,058 | 8/1960 | Daly | 248/475 B X |
| 3,408,033 | 10/1968 | Kochevar et al. | 248/479 X |
| 3,646,696 | 3/1972 | Sarkisan | 40/125 H |

*Primary Examiner*—John F. Pitrelli
*Attorney, Agent, or Firm*—Alexander Mencher

[57] ABSTRACT

A flexible or yieldably supported advertising sign for installation on merchandise racks, showcases, carpet display stands or "waterfalls" and the like for appropriate and necessary information to prospective purchasers on the contained merchandise and adapted to maintain a vertical position when free of overlying items for full viewing and lying in substantial horizontal position when loaded by the weight of said items. The sign or flag is adapted to automatically return to vertical position when said load is removed for continuing advertising function. The sign comprises a clip, a base member to which the clip is secured, a poster frame or panel to receive and exhibit advertising material and information and means for mounting the panel vertically along the clip, said means including yieldable interconnecting elements between the lower portion of the panel and a wall of the clip thereby permitting the panel to deflect downwardly upon application of items of merchandise thereagainst.

2 Claims, 5 Drawing Figures

FIG. 3
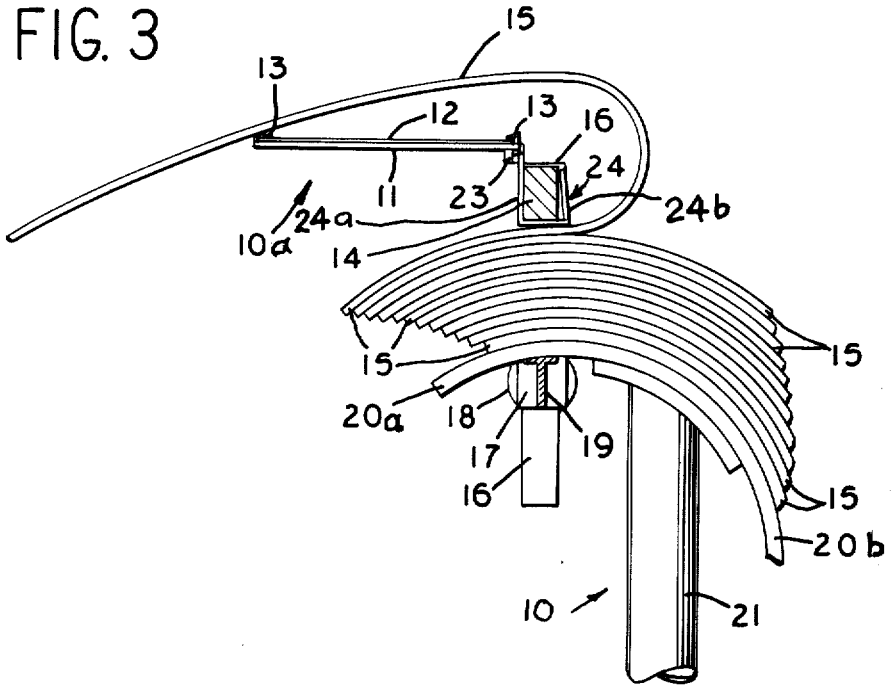
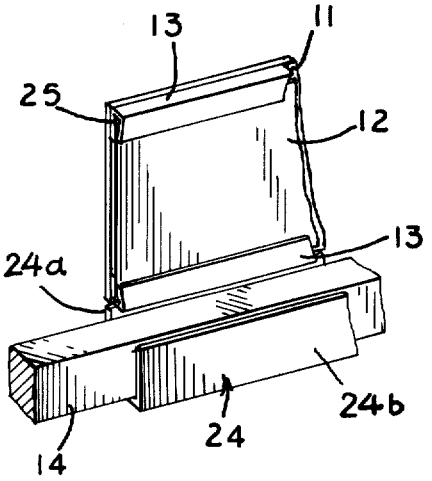
FIG. 4
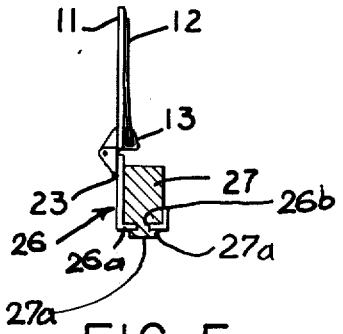
FIG. 5

FLEXIBLE FLAG ADVERTISING SIGN

BACKGROUND OF THE INVENTION

The invention relates to advertising signs, flags and similar devices for installation on merchandise rack, showcases, carpet stands or "waterfalls" and the like, and has for a main object the provision of a device of this character adapted to be supported in yieldable vertical position across the top of the rack, showcase or stand containing or featuring the relevant merchandise whereby appropriate and necessary information relating to the contained merchandise may be viewed by the prospective purchaser at all times except when the device is deflected downwardly by the load of items removed for inspection by a prior customer. Upon load removal, the device automatically returns to vertical position for continuing advertising function without the necessity of any manual manipulation.

The embodiment of the invention as described herein relates to application to a carpet stand or waterfall for inspection of carpet rug samples, but the embodiment is also applicable to other types of stands or racks and also to showcases.

A further object of the invention resides in the provision of a device of the above character wherein the poster frame or panel element has provision for removable mounting of merchandise description, origin, price, etc. by way of lettering, prints, photographs, drawings and the like for customer attraction and information relating to the particular merchandise rack or stand.

Yieldable signs have been heretofore known for many purposes and of various constructions, but none to applicants' knowledge have similar uses, construction and function.

Thus, U.S. Pat. No. 1,532,865 to Beck relates to a knock-down traffic signal; U.S. Pat. No. 1,750,118 to Mueller to an oscillatable sidewalk sign; U.S. Pat. No. 3,235,214 to Sprung to a parking space barrier; U.S. Pat. No. 3,616,557 to Vara to a knock-down highway sign; and U.S. Pat. No. 3,646,696 to Sarkisian to an oscillatable poster display.

Accordingly, further objects of the invention reside in the provision of a novel and yieldable advertising sign or flag structure removably affixable to a base member either afforded by the supporting rack or stand as in the case of the clamping member of a carpet waterfall as shown in the drawings herein, or as afforded by part and parcel of the flag structure.

Other objects of the invention reside in the provision of structure which is simple in construction, economical to manufacture, light in weight, easily removable, aesthetic in appearance and functional for all merchandise offered for sale in retail and other establishments wherein such merchandise is featured on racks, stands, showcases, other supports and the like.

These objects and other incidental ends and advantages of the invention will hereinafter appear in the progress of the disclosure and as pointed out in the appended claims.

BRIEF DESCRIPTION OF THE DRAWINGS

Accompanying this specification are drawings showing preferred forms of the invention wherein:

FIG. 3 is a partial elevation and sectional view of the carpet stand of FIG. 1 showing the panel component depressed and concealed by a throwover of the uppermost carpet rug mounted on the water fall for inspection of the rug series;

FIG. 4 is a partial view in perspective of the flag structure showing manner of removable insertion of advertising material in the panel component and also showing clip attachment to the base component as afforded by the clamping member of the water fall; and FIG. 5 is a side and sectional view of FIG. 4 but modified therefrom in showing a different means of attachment between the clip and base or clamping bar components.

DESCRIPTION OF EMBODIMENTS OF THE INVENTION

Figure 1:
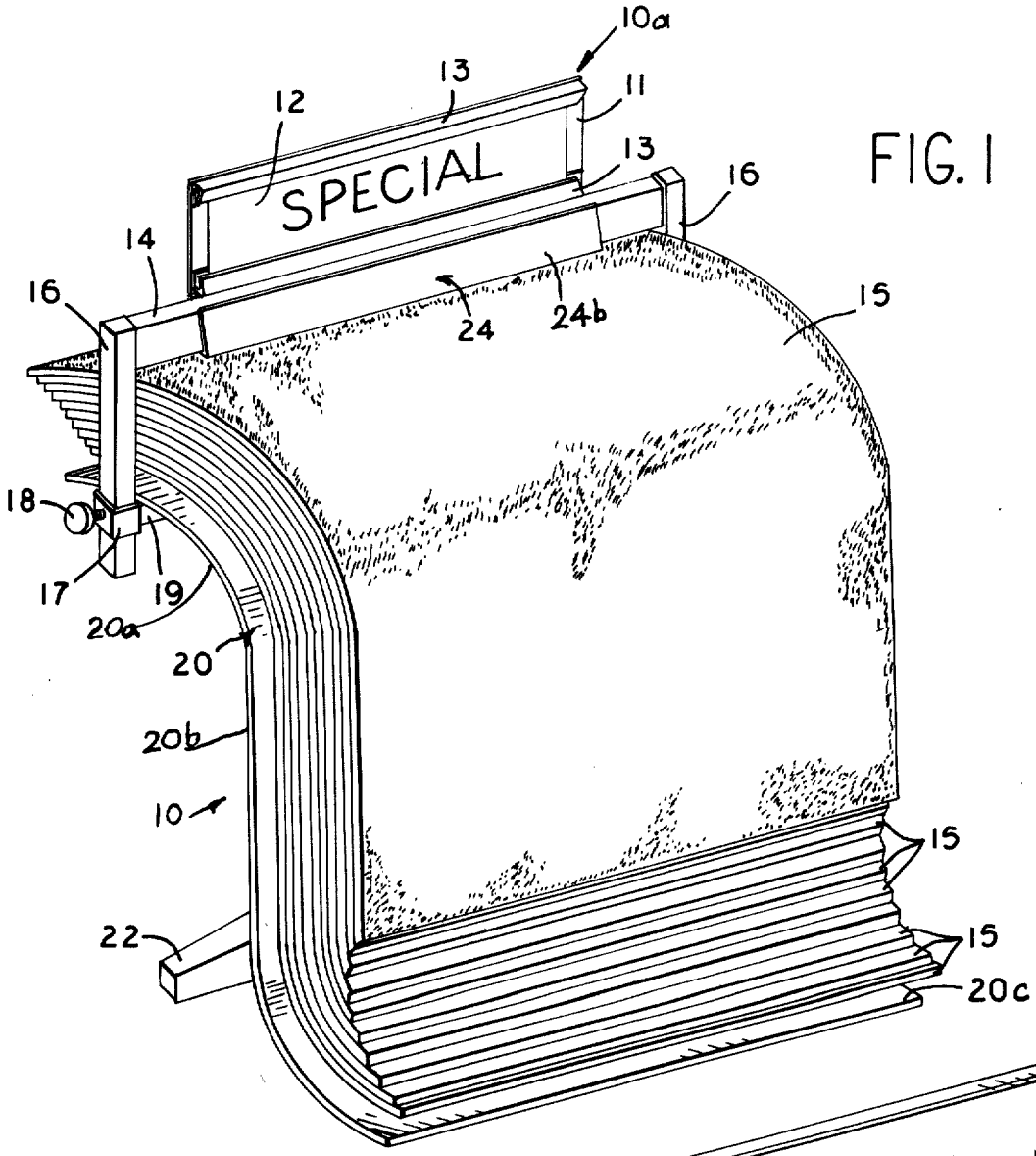
FIG. 1 is a view in perspective of a carpet stand or waterfall showing the poster frame or panel component of the flag structure in vertical and viewable position and showing the base member component afforded by the clamping member of the waterfall.

The invention as in illustrated forms shows a support generally indicated by numeral 10 for featuring and/or storing merchandise or samples and is adapted to have mounted thereon a poster display structure indicated generally by numeral 10a. The display poster structure is designed to have a yieldable and normally vertically disposed advertising panel 11 for containing relevant information and advertising of the goods on support 10. As shown, support 10 is in the form of a table 20 having upper and lower curved portions **20*a* and 20*c* and an intermediate vertical connecting portion 20*b*. Table portion 20*a* has spacedly mounted thereabove a base member 14 as a component of and from which panel 11** of the display structure yieldably projects as will more specifically be described hereinafter in the progress of the disclosure.

Although curved table 20 and base member 14 shall be described herein as components of a carpet display stand for capret samples known in the trade as a "waterfall" and wherein advertising panel 11 is adapted to be depressed as seen in FIG. 3 by the weight of a throwover sample rug 15 and is adapted to automatically return to vertical position to resume the advertising function upon removal of said rug 15, it is to be understood that the display structure **10*a*** is applicable for use on top of show cases and other table surfaces for information and advertising function as heretofore described.

The poster display structure **10*a* through its component element or panel 11 serves as the vertically projecting and yieldable part or flag thereof. Panel 11 may be of any suitable shape and is formed of substantially rigid material to serve as a backing for and to receive information or advertising material relevant to the merchandise featured and stored on or in the merchandise therebelow. Panel 11** may be made of metal, composition, of molded plastic or other suitable material.

As shown, panel 11 carries a sign 12 bearing the word "special" and is removably mounted as in grooves 25 in retaining channels 13 on the front face and along the upper and lower longitudinal edges thereof. It is understood that other types of retaining means may be used and that other informational elements including photographs, illustrations, prints, drawings, letters and other symbols may be resorted to for communication to prospective purchasers as to price, make, quality, beauty and the like respecting the merchandise.

Base member 14 of the poster display structure 10*a* as shown is in elongated form serving as an anchorage for the yieldable panel 11 which is operatively secured thereto as will appear. When not permanently secured to the table component 20 of the merchandise display support or waterfall construction 10 as shown in the drawings, member 14 lying on a portion of the merchandise display support should have sufficient weight or strength to function for the purposes intended of the poster display structure 10*a*.

Components in addition to panel 11 and base member 14 of the poster display structure 10*a* include means 23 for yieldably securing panel 11 to the base member as through an elongated and substantially channel-shaped clip 24 engaging base member 14. Means 23 are adapted to function as a resilient type of hinge and may be in the form of a plastic strip such as polypropylene or other suitable plastic secured between the lower longitudinal edge of panel 11 and the rear longitudinal wall 24*a* of clip 24 along the upper longitudinal edge thereof. It is to be noted that wall 24*a* of the clip extends above the top of base member 14 to better accommodate for hingeability.

Figure 2:
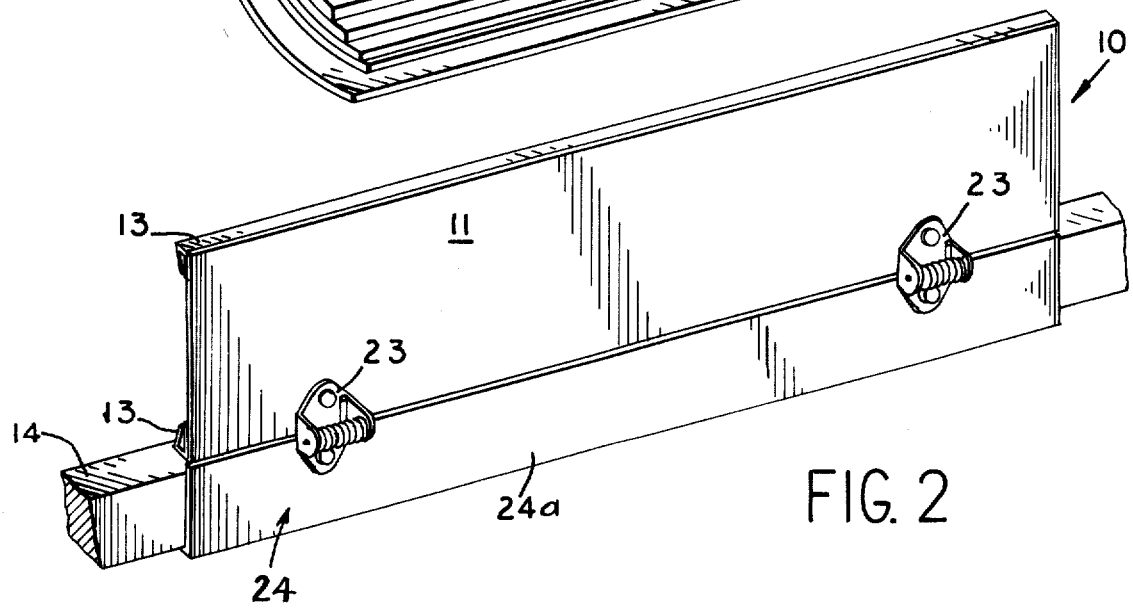
FIG. 2 is an enlarged and partial view in perspective showing the rear of the panel and clip components of the flag structure and a suitable or illustrative means of yieldable connection therebetween for normal vertical positioning of the panel component.

As shown, means 23 are in the form of a pair of identical spaced bracket-type hinges suitably spring-biased for maintenance of normal and projecting vertical position of panel 11 as best seen in FIG. 2. Each of the brackets 23 at the upper half portion is secured to the rear side and adjacent the lower longitudinal edge of panel 11, and at the lower half portion to the rear side of clip rear wall 24*a*. Panel 11 in deflected position is best seen in FIG. 3.

Clip 24 may be formed of spring material with an inwardly inclined front wall 24*b* to accommodate affixation to different sizes of base member 14. A modified form of clip is shown at 26 in FIG. 5, base wall 26*a* of clip 26 may be provided with suitable and spaced notches 26*b* to engage a runner 27*a* on the bottom of a base member 27 for conventional bayonet type of affixation between the panel and base members of the poster display structure 10*a* as best shown in FIG. 5.

Base member 14 when used on merchandise display structures in the form of a waterfall for carpeting samples as indicated generally by numeral 10 serves the additional function as an adjustable clamping bar in conjunction with the curved table component 20 for featuring samples of carpeting in the form of a series of superposed rugs 15 adapted to be thrown over and to depress panel 11 during inspection of a selected sample as seen in FIG. 3. Base member or its effective function as clamping bar 14 as shown is secured at the ends thereof to a pair of uprights 16 each slidably and adjustably secured in brackets 17 by suitable means as by locking screws 18. Brackets 17 are affixed to the underside of curved table component 20 outside of and adjacent the lateral edges thereof and at the upper end of said component 20 as at the ends of crossbrace 19, the latter being suitably secured to the underside of the table component 20. The latter is suitably supported as by an upright 21 extending from a floor base 22.

By referring to FIG. 3, it is seen that when a prospective purchaser wishes to view an intermediate rug sample, the purchaser throws superposed samples over the vertically extending flag or panel portion 11 thereby depressing the same and concealing the advertising material thereon. Before the approach of a subsequent prospective purchaser, either the prior party or a store or department employee returns the samples overlying panel 11 thereby causing automatic return to vertical and viewable position of panel 11. Provision of this type of merchandise advertising encourages the consumer in knowing what he or she is viewing and saves time of employees in providing repetitive answers to repetitive questioning.

It is understood that minor changes and variations in the material, size of parts, integration and positioning thereof of the invention may all be resorted to without departing from the spirit of the invention and the scope of the appended claims.

We claim:

1. A yieldable sign structure comprising a merchandise display support, an elongated base member and means to spacedly mount said base member on said support, an elongated springable securing clip of substantial channel formation removably and frictionally engaged to said base member along the side and bottom walls thereof and having a rear wall projecting above the top of said base member, an elongated panel member adapted to receive and feature advertising and informational material relating to said merchandise and adapted normally to project vertically above and spaced from said rear wall of said clip for viewing purposes, and resilient connecting means along and between said panel member adjacent the lower longitudinal edge thereof and said clip member along the upper longitudinal rear wall edge thereof for maintenance of normal vertical position of the said panel member, for yieldability of said panel member when weight of merchandise is thrown or placed thereagainst and for automatic return to normal vertical position when the weight of said merchandise is removed therefrom, said display support having a table component for support of merchandise, and said means to spacedly mount said base member on said support including adjustable means for clamping merchandise between the clip bottom wall and the said table component, said table component has an upper curved and a vertical portion for displaying superposed articles of merchandise supported thereon and adapted to be clamped between said base member having said clip engaged thereto and said curved portion whereby the uppermost article or articles are capable of being thrown over said panel member when said article or articles are returned back to their normal position.

2. A yieldable sign structure as set forth in claim 1 wherein said securing clip of channel formation is trapezoidal in section for removable engagement with said base member.

* * * * *